US012313341B2

(12) United States Patent
Satou et al.

(10) Patent No.: US 12,313,341 B2
(45) Date of Patent: May 27, 2025

(54) HEAT TRANSFER TUBE AND HEAT EXCHANGER

(71) Applicant: DAIKIN INDUSTRIES, LTD., Osaka (JP)

(72) Inventors: Ken Satou, Osaka (JP); Tomohiko Sakamaki, Osaka (JP); Kengo Uchida, Osaka (JP); Yoshio Oritani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 295 days.

(21) Appl. No.: 17/743,141

(22) Filed: May 12, 2022

(65) Prior Publication Data

US 2022/0268525 A1 Aug. 25, 2022

Related U.S. Application Data

(63) Continuation of application No. PCT/JP2020/040840, filed on Oct. 30, 2020.

(30) Foreign Application Priority Data

Nov. 14, 2019 (JP) ..... 2019-205903

(51) Int. Cl.
*F28D 1/053* (2006.01)
*F25B 13/00* (2006.01)
(Continued)

(52) U.S. Cl.
CPC ..... *F28D 1/05391* (2013.01); *F25B 13/00* (2013.01); *F25B 39/00* (2013.01);
(Continued)

(58) Field of Classification Search
CPC ..... F28D 1/05391; F28F 1/022
See application file for complete search history.

(56) References Cited

U.S. PATENT DOCUMENTS 5,458,190 A * 10/1995 Sasaki ..... F28F 1/128 165/110
5,476,141 A * 12/1995 Tanaka ..... F28D 1/05391 165/173
(Continued)

FOREIGN PATENT DOCUMENTS

EP 3483544 A1 5/2019
JP S57-106482 U 6/1982
(Continued)

OTHER PUBLICATIONS

Extended European Search Report issued in corresponding European Patent Application No. 20887565.8, dated Nov. 8, 2022 (7 pages).
(Continued)

*Primary Examiner* — Christopher R Zerphey
(74) *Attorney, Agent, or Firm* — Osha Bergman Watanabe & Burton LLP

(57) ABSTRACT

A heat transfer tube includes first flow paths aligned in the heat transfer tube. Each of the first flow paths includes a section with a rectangular shape that is elongated in a first direction parallel with an alignment direction of the first flow paths. Each of the first flow paths includes protrusions disposed on an inner surface. The section of each of the first flow paths has a long side having a first length and a short side having a second length, where a ratio of the first length to the second length is between 1.1 and 1.5.

6 Claims, 9 Drawing Sheets

(51) Int. Cl.

| | |
|---|---|
| ***F25B 39/00*** | (2006.01) |
| ***F25B 39/02*** | (2006.01) |
| ***F28D 21/00*** | (2006.01) |
| ***F28F 1/02*** | (2006.01) |
| ***F28F 1/12*** | (2006.01) |
| ***F28F 1/40*** | (2006.01) |

(52) U.S. Cl.

CPC ..... *F25B 39/028* (2013.01); *F28F 1/022* (2013.01); *F28F 1/128* (2013.01); *F28F 1/40* (2013.01); *F28D 2021/0068* (2013.01); *F28F 2215/12* (2013.01)

(56) References Cited

U.S. PATENT DOCUMENTS

| | | | | |
|---|---|---|---|---|
| 6,000,467 | A * | 12/1999 | Tokizaki | F28F 1/40 165/110 |
| 7,059,399 | B2 * | 6/2006 | Chin | F28F 1/24 165/146 |
| 9,459,053 | B2 * | 10/2016 | Lee | F28D 9/0062 |
| 9,733,025 | B2 * | 8/2017 | Hokazono | B23P 15/26 |
| 10,309,701 | B2 * | 6/2019 | Morimoto | F28F 1/022 |
| 10,712,104 | B2 * | 7/2020 | Maeda | F28D 1/05391 |
| 11,226,161 | B2 * | 1/2022 | Jo | F28F 1/12 |
| 2009/0065183 | A1 | 3/2009 | Uneno | |

FOREIGN PATENT DOCUMENTS

| | | | |
|---|---|---|---|
| JP | H02166393 | A | 6/1990 |
| JP | H06-185885 | A | 7/1994 |
| JP | H11044498 | A | 2/1999 |
| JP | 2000-18867 | A | 1/2000 |
| JP | 2000-154987 | A | 6/2000 |
| JP | 2003200212 | A | 7/2003 |
| JP | 2005-90760 | A | 4/2005 |
| JP | 2009-063228 | A | 3/2009 |
| JP | 2013-19596 | A | 1/2013 |
| JP | 2013024472 | A | 2/2013 |
| JP | 2018054272 | A | 4/2018 |
| WO | 2013187435 | A1 | 12/2013 |
| WO | 2017/141943 | A1 | 8/2017 |
| WO | 2018/008134 | A1 | 1/2018 |

OTHER PUBLICATIONS

International Search Report issued in corresponding International Application No. PCT/JP2020/040840, mailed on Nov. 24, 2020 (3 pages).

International Preliminary Report on Patentability issued in corresponding International Application No. PCT/JP2020/040840 mailed May 27, 2022 (6 pages).

* cited by examiner

HEAT TRANSFER TUBE AND HEAT EXCHANGER

TECHNICAL FIELD

The present disclosure relates to a heat transfer tube and a heat exchanger.

BACKGROUND

Recent air conditioners may include microchannel heat exchangers having high heat exchange efficiency and enabling reduction in size and weight. Such a microchannel heat exchanger includes a heat transfer tube that has a plurality of aligned internal flow paths and is called a porous tube (see PATENT LITERATURE 1, for example). This heat transfer tube has heat exchange between a refrigerant flowing in each of the flow paths and air flowing around the heat transfer tube in an alignment direction of the plurality of flow paths. In the heat transfer tube according to PATENT LITERATURE 1, each of the flow paths has an inner surface provided with a plurality of protrusions that increases a contact area with the refrigerant.

CITATION LIST

Patent Literature

PATENT LITERATURE 1: Japanese Laid-Open Patent Publication No. 2009-63228

SUMMARY

One or more embodiments of the present disclosure provide a heat transfer tube including a plurality of first flow paths aligned in the heat transfer tube, in which the first flow paths each have a section in a rectangular shape elongated in a first direction in parallel with an alignment direction of the plurality of first flow paths, the first flow paths each have an inner surface provided with a plurality of protrusions, and the section of each of the first flow paths has a long side having a length and a short side having a length, the lengths having a ratio from 1.1 to 1.5.

DETAILED DESCRIPTION

Embodiments of the present disclosure will be described in detail hereinafter with reference to the accompanying drawings.

Figure 1:
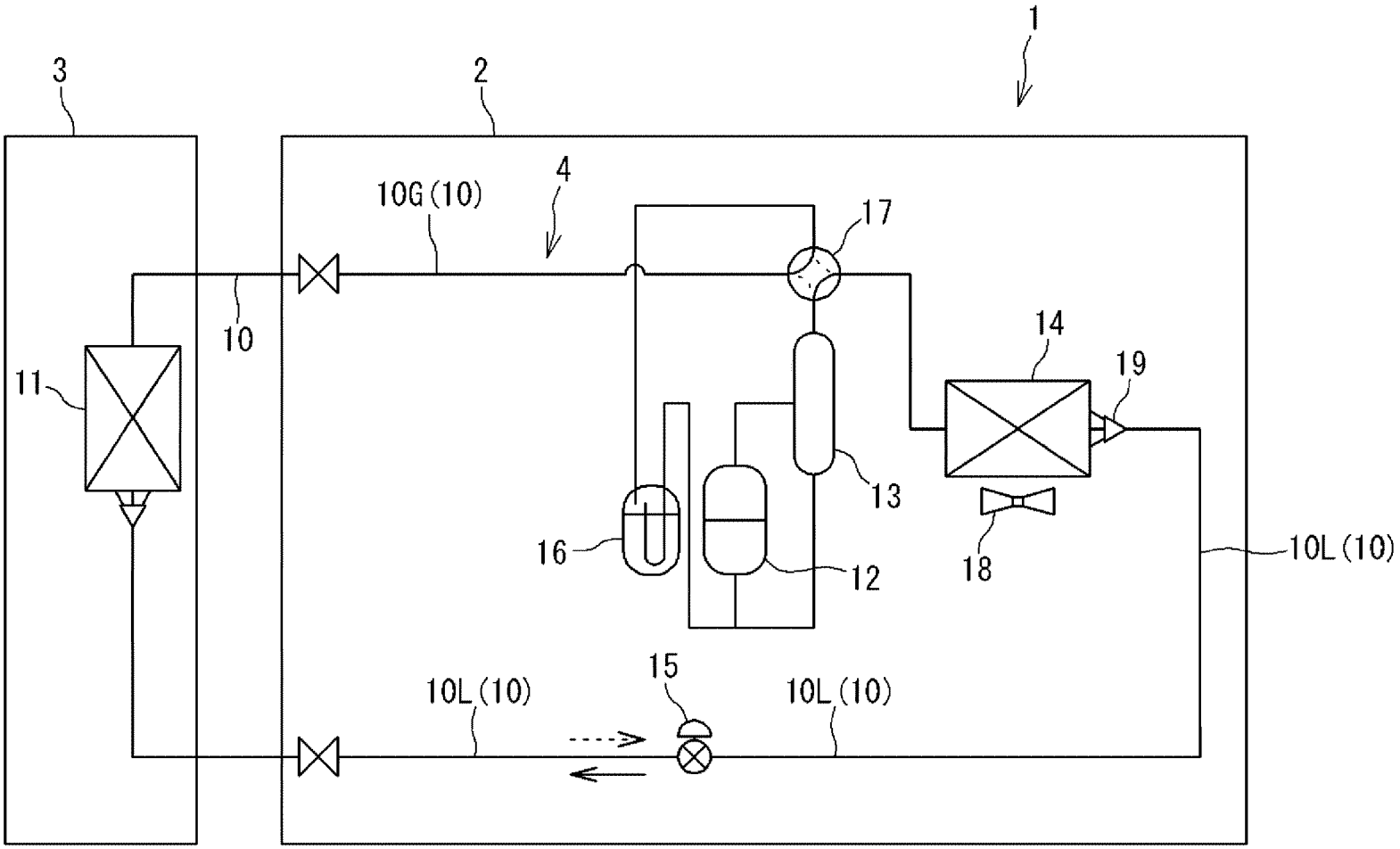
FIG. 1 is a schematic configuration diagram of an air conditioner according to one or more embodiments of the present disclosure.

FIG. 1 is a schematic configuration diagram of an air conditioner according to one or more embodiments of the present disclosure.

An air conditioner 1 functioning as a refrigeration apparatus includes an outdoor unit 2 disposed outdoors and an indoor unit 3 disposed indoors. The outdoor unit 2 and the indoor unit 3 are connected to each other by a connection pipe. The air conditioner 1 includes a refrigerant circuit 4 configured to execute vapor compression refrigeration cycle operation. The refrigerant circuit 4 is provided with an indoor heat exchanger 11, a compressor 12, an oil separator 13, an outdoor heat exchanger 14, an expansion valve (expansion mechanism) 15, an accumulator 16, a four-way switching valve 17, and the like, which are connected by a refrigerant pipe 10. The refrigerant pipe 10 includes a liquid pipe 10L and a gas pipe 10G.

The indoor heat exchanger 11 is configured to execute heat exchange between a refrigerant and indoor air, and is provided in the indoor unit 3. Examples of the indoor heat exchanger 11 include a fin-and-tube heat exchanger of a cross-fin type and a heat exchanger of a microchannel type. The indoor heat exchanger 11 is provided therearound with an indoor fan (not depicted) configured to send indoor air to the indoor heat exchanger 11.

The compressor 12, the oil separator 13, the outdoor heat exchanger 14, the expansion valve 15, the accumulator 16, and the four-way switching valve 17 are provided in the outdoor unit 2.

The compressor 12 is configured to compress a refrigerant sucked from a suction port and discharge the compressed refrigerant from a discharge port. Examples of the compressor 12 include various compressors such as a scroll compressor.

The oil separator 13 is configured to separate lubricant from fluid mixture that contains the lubricant and a refrigerant and that is discharged from the compressor 12. The refrigerant thus separated is sent to the four-way switching valve 17 whereas the lubricant is returned to the compressor 12.

The outdoor heat exchanger 14 is configured to execute heat exchange between a refrigerant and outdoor air. The outdoor heat exchanger 14 according to one or more embodiments is of the microchannel type. The outdoor heat exchanger 14 is provided therearound with an outdoor fan 18 configured to send outdoor air to the outdoor heat exchanger 14. The outdoor heat exchanger 14 has a liquid side end connected with a refrigerant flow divider 19 including a capillary tube.

The expansion valve 15 is disposed between the outdoor heat exchanger 14 and the indoor heat exchanger 11 in the refrigerant circuit 4, and expands an incoming refrigerant to be decompressed to have predetermined pressure. Examples of the expansion valve 15 include an electronic expansion valve having a variable opening degree.

The accumulator 16 is configured to separate an incoming refrigerant into a gas refrigerant and a liquid refrigerant, and is disposed between the suction port of the compressor 12 and the four-way switching valve 17 in the refrigerant circuit 4. The gas refrigerant thus separated by the accumulator 16 is sucked into the compressor 12.

The four-way switching valve 17 is configured to be switchable between a first state indicated by solid lines in FIG. 1 and a second state indicated by broken lines. The four-way switching valve 17 is switched into the first state while the air conditioner 1 executes cooling operation, and the four-way switching valve 17 is switched into the second state while the air conditioner 1 executes heating operation.

When the air conditioner 1 executes cooling operation, the outdoor heat exchanger 14 functions as a refrigerant condenser (radiator) and the indoor heat exchanger 11 functions as a refrigerant evaporator. A gas refrigerant discharged from the compressor 12 condenses at the outdoor heat exchanger 14, is then decompressed at the expansion valve 15, and evaporates at the indoor heat exchanger 11 to be sucked into the compressor 12. Also, during defrosting operation of removing frost adhering to the outdoor heat exchanger 14 due to heating operation, as in cooling operation, the outdoor heat exchanger 14 functions as a refrigerant condenser and the indoor heat exchanger 11 functions as a refrigerant evaporator.

When the air conditioner 1 executes heating operation, the outdoor heat exchanger 14 functions as a refrigerant evaporator and the indoor heat exchanger 11 functions as a refrigerant condenser. The gas refrigerant discharged from the compressor 12 condenses at the indoor heat exchanger 11, is then decompressed at the expansion valve 15, and evaporates at the outdoor heat exchanger 14 to be sucked into the compressor 12.

[Configuration of Outdoor Heat Exchanger]

Figure 2:
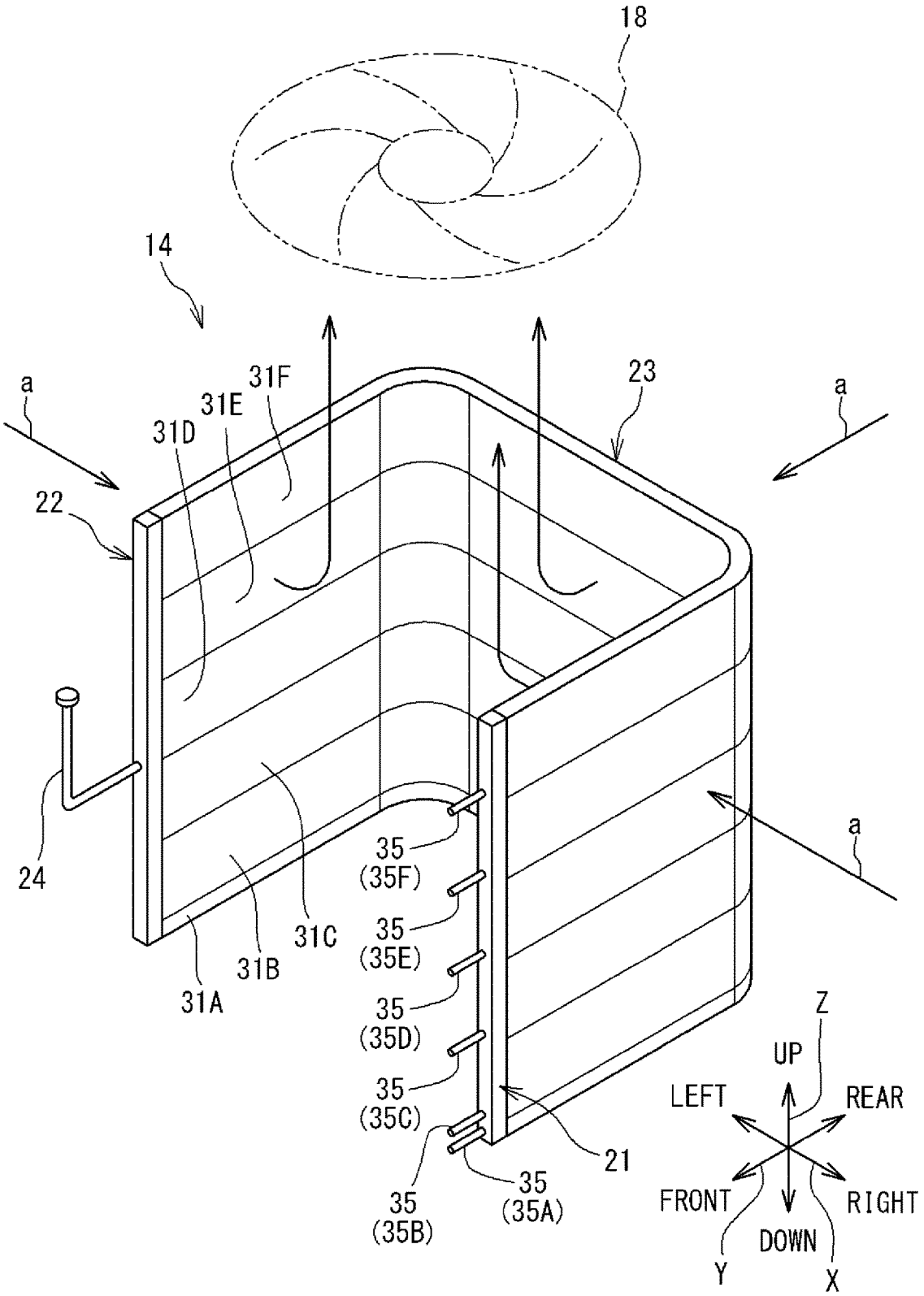
FIG. 2 is a perspective view depicting an outdoor heat exchanger of the air conditioner.
Figure 3:
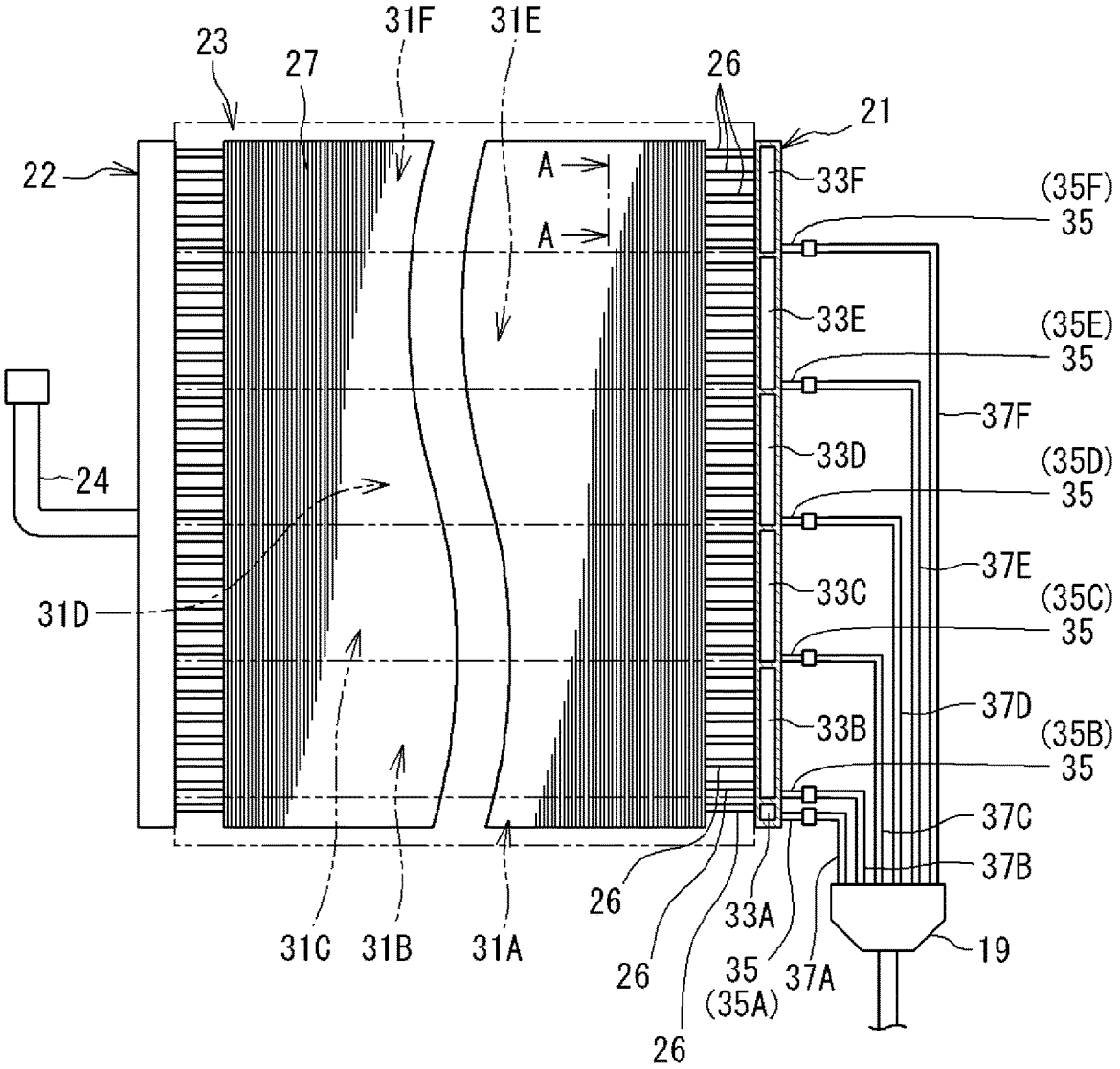
FIG. 3 is a schematic developed view depicting the outdoor heat exchanger.
Figure 4:
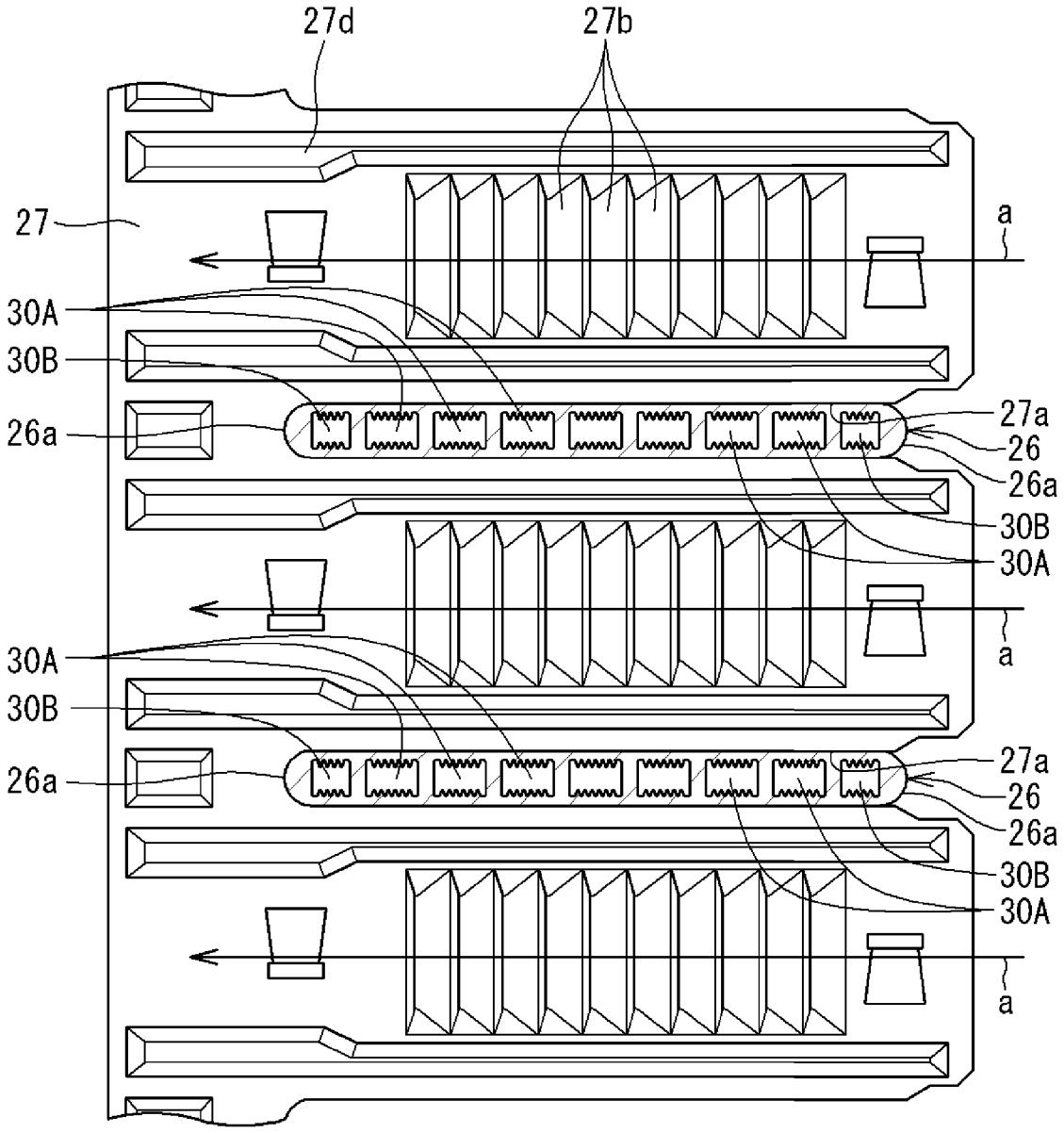
FIG. 4 is a sectional view taken along arrow A-A indicated in FIG. 3.

FIG. 2 is a perspective view depicting the outdoor heat exchanger of the air conditioner. FIG. 3 is a schematic developed view depicting the outdoor heat exchanger. FIG. 4 is a sectional view taken along arrow A-A indicated in FIG. 3.

The following description may include expressions such as "up", "down", "left", "right", "front (before)", and "rear (behind)", for indication of directions and positions. These expressions follow directions indicated by arrows in FIG. 2, unless otherwise specified. Specifically, the following description assumes that a direction indicated by arrow X in FIG. 2 is a lateral direction, a direction indicated by arrow Y is an anteroposterior direction, and a direction indicated by arrow Z is a vertical direction. These expressions describing the directions and the positions are adopted for convenience of description, and do not limit, unless otherwise specified, directions or positions of the entire outdoor heat exchanger 14 and various constituents of the outdoor heat exchanger 14 to the directions or the positions described herein.

The outdoor heat exchanger 14 is configured to cause heat exchange between a refrigerant flowing inside and air. The outdoor heat exchanger 14 according to one or more embodiments has a substantially U shape in a top view. The outdoor heat exchanger 14 is exemplarily accommodated in a casing of the outdoor unit 2 having a rectangular parallelepiped shape, and is disposed to face three side walls of the casing. The outdoor heat exchanger 14 according to one or more embodiments includes a pair of headers 21 and 22, and a heat exchanger body 23. The pair of headers 21 and 22 and the heat exchanger body 23 are made of aluminum or an aluminum alloy.

The pair of headers 21 and 22 is disposed at respective ends of the heat exchanger body 23. The header 21 is a liquid header configured to allow a liquid refrigerant (gas-liquid two-phase refrigerant) to flow therein. The header 22 is a gas header configured to allow a gas refrigerant to flow therein. The liquid header 21 and the gas header 22 are each disposed to have a longitudinal direction aligned to a vertical direction Z. The liquid header 21 is connected with the refrigerant flow divider 19 including capillary tubes 37A to 37F. The gas header 22 is connected with a gas pipe 24.

The heat exchanger body 23 is configured to execute heat exchange between a refrigerant flowing inside and air. Air passes along arrow a from outside to inside the heat exchanger body 23 having the substantially U shape so as to cross the heat exchanger body 23.

As depicted in FIG. 3, the heat exchanger body 23 includes a plurality of heat transfer tubes 26 and a plurality of fins 27. The plurality of heat transfer tubes 26 is disposed horizontally. The plurality of heat transfer tubes 26 is aligned in the vertical direction in parallel with the longitudinal direction of the headers 21 and 22. Each of the heat transfer tubes 26 has a first longitudinal end part connected to the liquid header 21. Each of the heat transfer tubes 26 has a second longitudinal end part connected to the gas header 22.

As depicted in FIG. 4, each of the heat transfer tubes 26 according to one or more embodiments is a porous tube provided with a plurality of refrigerant flow paths 30A and 30B. The flow paths 30A and 30B extend in a longitudinal direction of the heat transfer tube 26. A refrigerant flowing in each of the flow paths 30A and 30B of the heat transfer tube 26 has heat exchange with air. The plurality of flow paths 30A and 30B is aligned in an air flow direction a with respect to the heat exchanger body 23. Air passes through a vertical space between the plurality of heat transfer tubes 26. The heat transfer tubes 26 each have a flat shape having a vertical length less than a length in an alignment direction of the plurality of flow paths 30A and 30B (the air flow direction a). The heat transfer tubes 26 each have respective end surfaces 26*a* in the alignment direction of the plurality of flow paths 30A and 30B, and the end surfaces 26*a* each have a semiarcuate shape.

The plurality of fins 27 is aligned in the longitudinal direction of the heat transfer tubes 26. The fins 27 are vertically elongated thin plates. The fins 27 are each provided with a plurality of grooves 27*a* extending from a first side 27*c* toward a second side in the air flow direction a and aligned to be vertically spaced apart from each other. The grooves 27*a* are opened at the first side 27*c* of the fin 27. The heat transfer tubes 26 are inserted to the grooves 27*a* of the fins 27 to be attached to the fins 27. The fins 27 are each provided with a louver 27*b* for promotion of heat transfer, and a reinforcing rib 27*d*.

The heat exchanger body 23 exemplarily depicted in FIG. 2 and FIG. 3 includes a plurality of heat exchange units 31A to 31F. The plurality of heat exchange units 31A to 31F is aligned in the vertical direction. The liquid header 21 has an interior vertically zoned respectively for the heat exchange units 31A to 31F. In other words, as depicted in FIG. 3, the interior of the liquid header 21 is provided with flow paths 33A to 33F respectively for the heat exchange units 31A to 31F.

The liquid header 21 is connected with a plurality of connecting tubes 35A to 35F. The connecting tubes 35A to 35F are provided correspondingly to the flow paths 33A to 33F. The connecting tubes 35A to 35F are connected with the capillary tubes 37A to 37F of the refrigerant flow divider 19.

During heating operation, a liquid refrigerant obtained through dividing by the refrigerant flow divider 19 flows through the capillary tubes 37A to 37F and the connecting tubes 35A to 35F, flows into the flow paths 33A to 33F in the liquid header 21, and flows through one or some of the heat transfer tubes 26 connected to the flow paths 33A to 33F to reach the gas header 22. In contrast, during cooling operation or defrosting operation, a refrigerant divided into the heat transfer tubes 26 at the gas header 22 flows into the flow paths 33A to 33F of the liquid header 21, and flows from the flow paths 33A to 33F to the capillary tubes 37A to 37F to join at the refrigerant flow divider 19.

The gas header 22 has an interior not zoned but provided continuously for all the heat exchange units 31A to 31F. The refrigerant flowing from the single gas pipe 24 into the gas header 22 is accordingly divided into all the heat transfer tubes 26, and the refrigerant flowing from all the heat transfer tubes 26 into the gas header 22 is joined at the gas header 22 to flow into the single gas pipe 24.

[Specific Configuration of Heat Transfer Tube]

Figure 5:
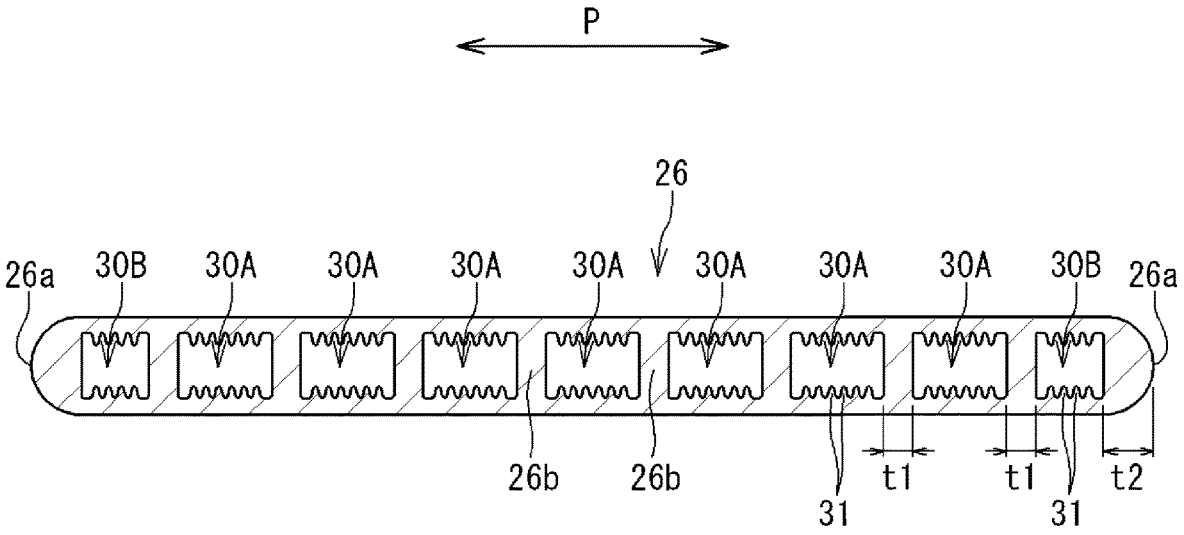
FIG. 5 is a sectional view of a heat transfer tube.
Figure 6:
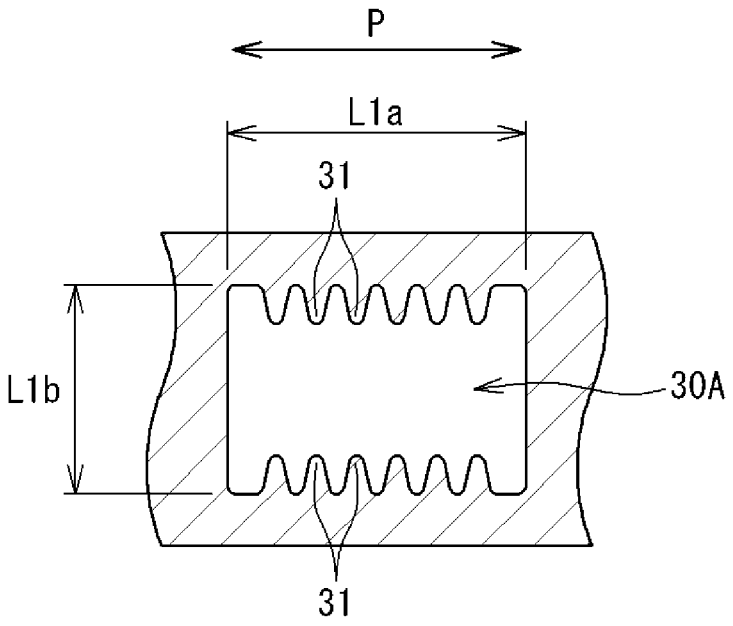
FIG. 6 is an enlarged sectional view depicting a first flow path of the heat transfer tube.
Figure 7:
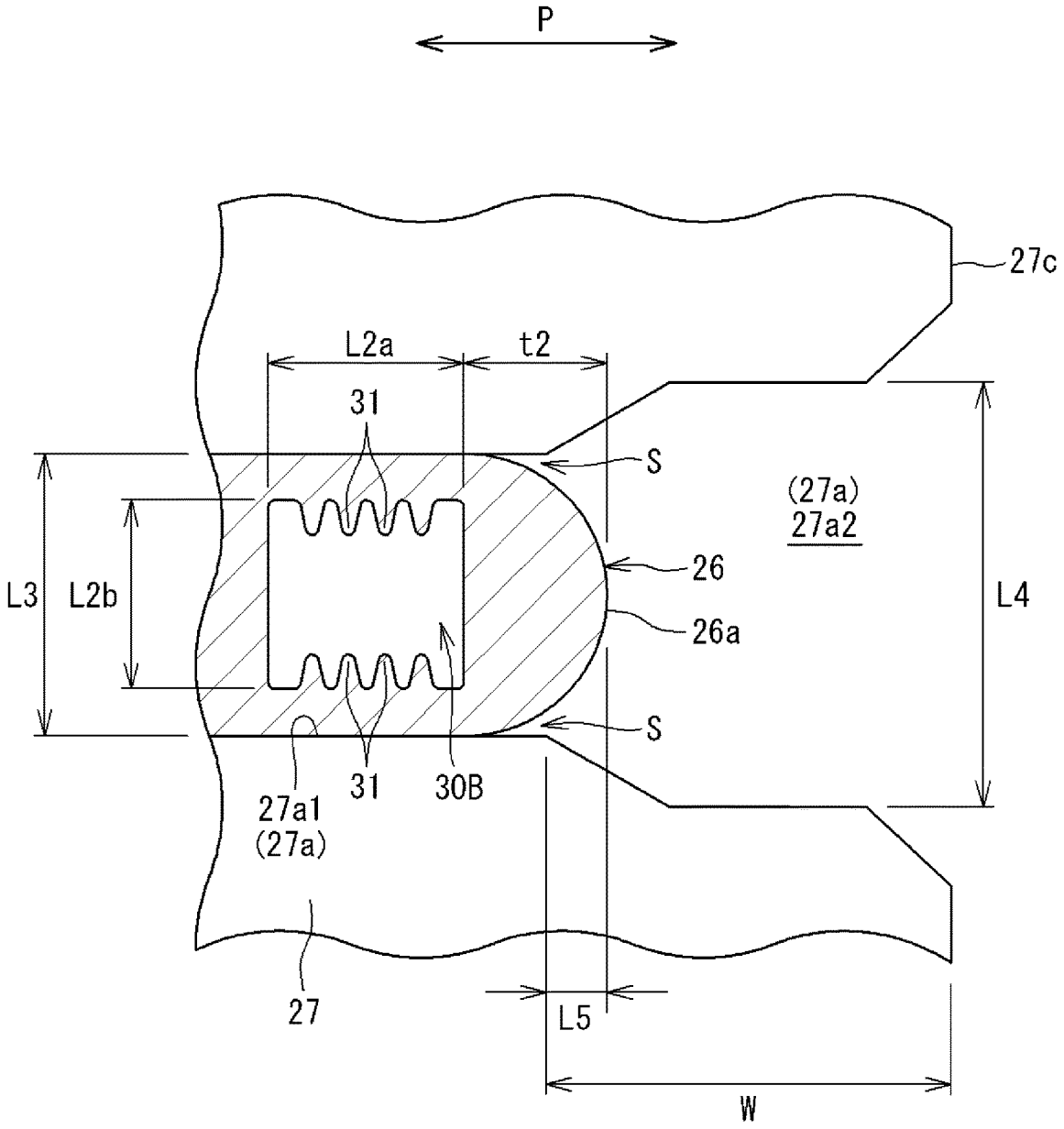
FIG. 7 is an enlarged sectional view depicting a second flow path of the heat transfer tube.

FIG. 5 is a sectional view of the heat transfer tube. FIG. 6 is an enlarged sectional view depicting a first flow path of the heat transfer tube. FIG. 7 is an enlarged sectional view depicting a second flow path of the heat transfer tube.

As depicted in FIG. 5, the heat transfer tube 26 is provided with the plurality of flow paths 30A and 30B. The heat transfer tube 26 has respective ends in the air flow direction a each provided with a second flow path 30B. The two second flow paths 30B interpose a plurality of aligned first flow paths 30A. One or more embodiments provide seven first flow paths 30A and the two second flow paths 30B aligned linearly in the air flow direction a. Hereinafter, an alignment direction of the flow paths 30A and 30B will be also called a "first direction P".

As depicted in FIG. 6, the first flow path 30A has a rectangular section elongated in the first direction P. In FIG. 6, the section of the first flow path 30A has a long side having a length (length in the first direction P) denoted by L1*a*, and a short side having a length (length in the vertical direction) denoted by L1*b*. The first flow path 30A has an inner surface provided with a plurality of protrusions 31. Specifically, the plurality of protrusions 31 is provided on inner surfaces located on two long sides in the section of the first flow path 30A. FIG. 6 exemplifies a case where the inner surfaces each have six protrusions 31. The protrusions 31 are tapered to be gradually reduced in length in the first direction P toward tip ends.

As depicted in FIG. 7, the second flow path 30B has a rectangular section elongated in the first direction P. In FIG. 7, the section of the second flow path 30B has a long side having a length denoted by L2*a*, and a short side having a length denoted by L2*b*. The length L2*a* of the long side of the second flow path 30B is shorter than the length L1*a* of the long side of the first flow path 30A. The length L2*b* of the short side of the second flow path 30B is equal to the length L1*b* of the short side of the first flow path 30A. The second flow path 30B is smaller in sectional area than the first flow path 30A.

The second flow path 30B has an inner surface provided with a plurality of protrusions 31. Specifically, the plurality of protrusions 31 is provided on inner surfaces located on two long sides in the section of the second flow path 30B. FIG. 7 exemplifies a case where the inner surfaces each have four protrusions 31. The protrusions 31 of the second flow path 30B are equal in shape to the protrusions 31 of the first flow path 30A. The length L2*a* of the long side of the second flow path 30B is shorter than the length L1*a* of the long side of the first flow path 30A, so that the protrusions 31 formable at the second flow path 30B are smaller in the number than the protrusions 31 formable at the first flow path 30A.

Provision of the protrusions 31 on the inner surfaces of the first and second flow paths 30A and 30B as described above leads to increase in surface area of the flow paths for improvement in heat exchange efficiency.

(About Shape of First Flow Path 30A)

The first flow path 30A has the rectangular section, and the length L1*a* of the long side and the length L1*b* of the short side of the rectangular shape have a ratio as an aspect ratio set from 1.1 to 1.5. The aspect ratio is set to such a value in consideration of the following matters (1) to (4).

(1) As depicted in FIG. 4, when air flows in the alignment direction of the first flow paths 30A (hereinafter, also simply called "flow paths") in the heat transfer tube 26, the refrigerant in the flow paths 30A and air have a large temperature difference on an upstream side in the air flow direction a (right side in FIG. 4) to achieve efficient heat exchange. In contrast, air having had heat exchange on the upstream side flows to a downstream side in the air flow direction a (left side in FIG. 4), so that the refrigerant in the flow paths 30A and such air have a small temperature difference. The downstream side thus has lower heat exchange efficiency than the upstream side. The refrigerant flowing in the flow path 30A disposed upstream in the air flow direction a and the refrigerant flowing in the flow path 30A disposed downstream in the air flow direction a are different from each other in terms of timing of state change. The outdoor heat exchanger 14 is thus designed to cause appropriate state change of the refrigerant in the downstream flow path 30A. However, if the upstream flow path 30A and the downstream flow path 30A have a large difference in heat exchange efficiency, the upstream flow path 30A has a flow of the refrigerant having been changed in state into the outdoor heat exchanger 14 with waste of performance. This phenomenon is inhibited when the flow paths 30A in the heat transfer tube 26 are reduced in the number without reduction in total sectional area of the flow paths 30A. The section of each of the flow paths 30A is thus usefully formed into the rectangular shape elongated in the air flow direction a.

(2) When the section of the flow path 30A is formed into the rectangular shape on the basis of the idea of the above (1), the more protrusions 31 can be provided on the inner surface of the long side of the flow path 30A as the long side is made longer (as the aspect ratio is increased). The flow path 30A can thus be increased in surface area, to expect improvement in heat exchange efficiency.

(3) However, increase in length of the long side in the section of the flow path 30A leads to decrease in the number of the flow paths 30A in the heat transfer tube 26 and decrease in the number of walls 26*b* (see FIG. 5) partitioning between the flow path 30A and the flow path 30A, which deteriorates strength of the heat transfer tube 26. The walls 26*b* need to be increased in thickness t1 to prevent deterioration in strength of the heat transfer tube 26. Accordingly, increase in length of the long side in the section of the flow path 30A does not proportionally lead to increase in surface area of the flow path 30A.

(4) Increase in length of the long side in the section of each of the flow paths 30A leads to decrease in flow speed of the refrigerant in the flow path 30A, so that each of the flow paths (single flow path) 30A may have deteriorated heat exchanging performance. Furthermore, increase in length of the long side in the section of the flow path 30A generates a region where the refrigerant is not in contact with the inner surface of the flow path 30A around a center of the long side in the inner surface of the flow path 30A. The region in the inner surface not in contact with the refrigerant cannot achieve heat exchange with the refrigerant, which leads to deterioration in heat exchange efficiency.

Figure 9:
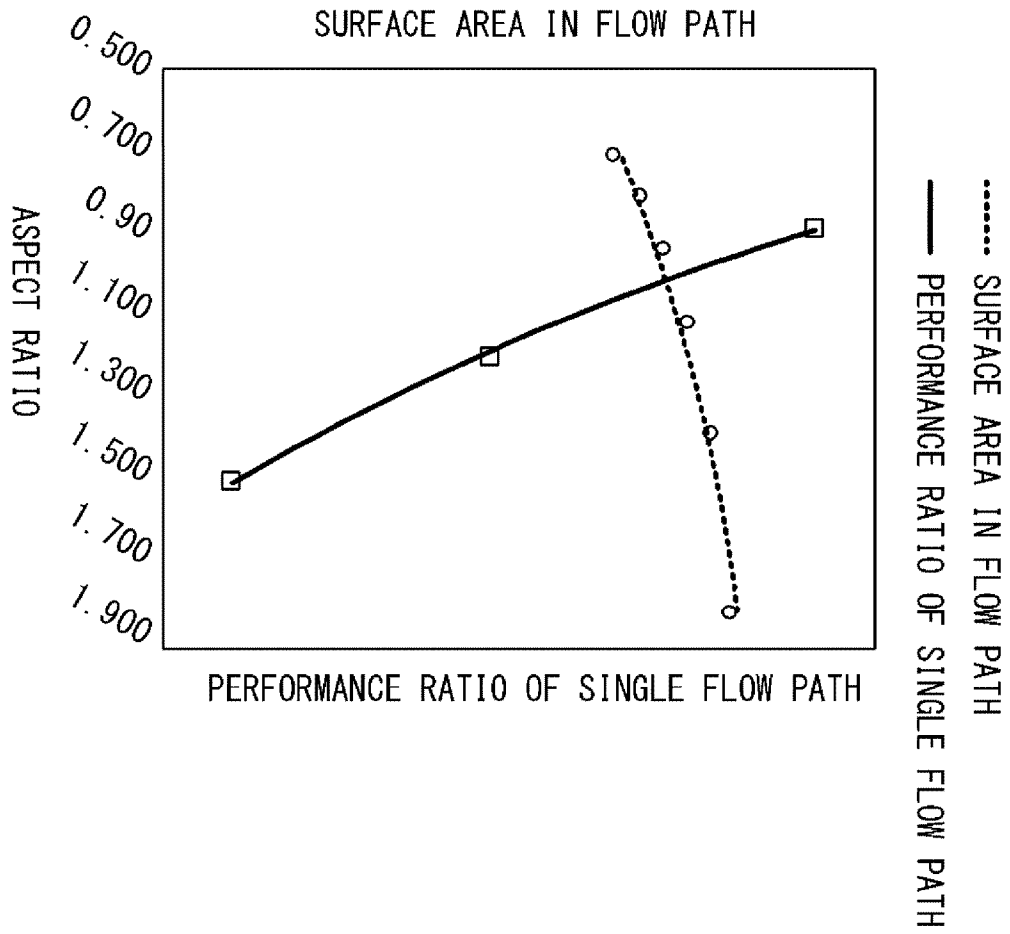
FIG. 9 is a graph indicating a relation among the aspect ratio, a surface area in a flow path, and the heat exchanging performance ratio of a single flow path.

FIG. 9 is a graph indicating a relation among the aspect ratio, the surface area in the flow path, and a heat exchanging performance ratio of the single flow path. According to FIG.

9, the surface area in the flow path increases as the aspect ratio of the flow path increases, whereas the heat exchanging performance ratio of each of the flow paths decreases as the aspect ratio increases.

The inventor of the present application has obtained a relation between the aspect ratio of the flow paths and heat exchanging performance of the heat transfer tube 26 under conditions A to F indicated in Table 1, in consideration of the matters (1) to (4) and the relation indicated in FIG. 9.

In Table 1, the number of the flow paths is changed under the six conditions A to F in a state where the heat transfer tube 26 has a fixed vertical length (thickness) and a fixed length in the first direction P, to set the thickness of the walls, the aspect ratio, and the number of the protrusions (the number of the grooves) in accordance with the number of the flow paths and obtain the heat exchanging performance ratio. The heat exchanging performance ratio is obtained with respect to a ratio assumed to 100% under the condition A. The heat transfer tube 26 has the vertical length of 2.0 mm and the length in the first direction P of 22.2 mm.

Figure 8:
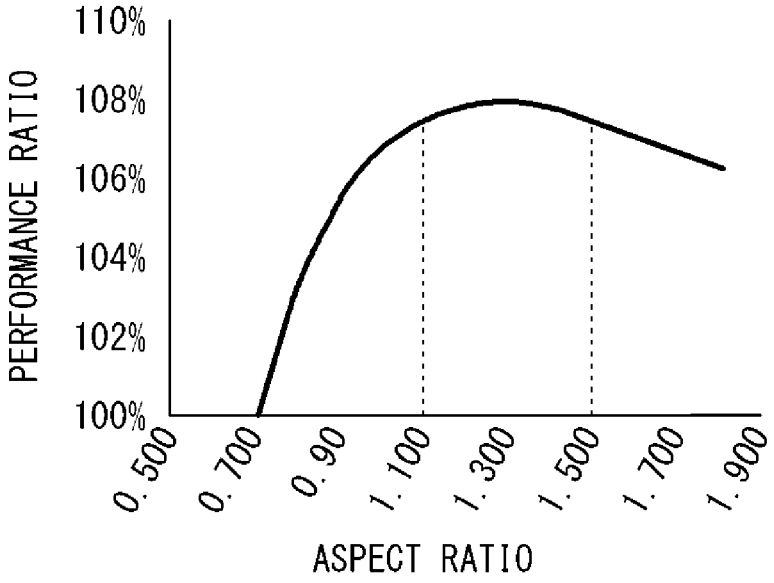
FIG. 8 is a graph indicating a relation between an aspect ratio and a heat exchanging performance ratio.

FIG. 8 is a graph indicating a relation between the aspect ratio of the flow path indicated in Table 1 and the heat exchanging performance ratio.

As indicated in FIG. 8, the heat exchanging performance ratio increases while the aspect ratio is from 0.7 to 1.3, and then decreases. When the aspect ratio exceeds 1.3, the heat exchanging performance ratio will be influenced more largely by increase in thickness of the walls between the flow paths and deterioration in performance of each of the flow paths rather than increase in surface area in the flow paths. The heat transfer tube 26 according to one or more embodiments adopts a value from 1.1 to 1.5 as the aspect ratio achieving appropriate heat exchanging performance on the basis of results of Table 1 and FIG. 8, to set the lengths La1 and La2 of the long side and the short side in the section of the first flow path 30A.

The first flow paths 30A have a distance (the thickness of the wall 26*b*) t1 that is appropriately set to be from 0.5 mm to 0.6 mm.

(About Shapes of Second Flow Path 30B and End Surface 26*a* of Heat Transfer Tube 26)

As depicted in FIG. 5 and FIG. 7, a cooled refrigerant passes through the heat transfer tube 26 when the outdoor heat exchanger 14 is used as an evaporator, so that the heat transfer tube 26 has lower surface temperature and may have frost. Particularly, as depicted in FIG. 4, the end surface 26*a* on one side in the first direction P (right end surface) of the heat transfer tube 26 in the outdoor heat exchanger 14 is not in contact with the fin 27, so that heat does not transfer from the end surface 26*a* of the heat transfer tube 26 cooled by the refrigerant to the fin 27. The end surface 26*a* of the heat transfer tube 26 not in contact with the fin 27 accordingly has significant temperature decrease of the heat transfer tube 26 to be more likely to have frost. The end surface 26*a* of the heat transfer tube 26 not in contact with the fin 27 is positioned upstream in the air flow direction a and is thus in contact with air containing moisture to be more likely to have frost.

According to one or more embodiments, the second flow path 30B is provided at each of the end parts in the heat transfer tube 26 in the first direction P. The second flow path 30B is smaller in sectional area than the first flow path 30A. The second flow path 30B is thus smaller in volume of the refrigerant flowing therein than the first flow path 30A, and has smaller volume of heat transfer to the end surface 26*a* of the heat transfer tube 26. Provision of the second flow path 30B at each of the end parts in the first direction P in the heat transfer tube 26 can thus achieve inhibition of frost on the end surface 26*a* of the heat transfer tube 26. The second flow path 30B according to one or more embodiments has an aspect ratio that is set to be less than 1.1, not within the range from 1.1 to 1.5 as the aspect ratio of the first flow path 30A.

As depicted in FIG. 5 and FIG. 7, a maximum distance (thickness at the end part of the heat transfer tube 26) t2 in the first direction P between the second flow path 30B and the end surface 26*a* of the heat transfer tube 26 in the first direction P closest to the second flow path 30B is larger than the distance (thickness of the wall 26*b*) t1 in the first direction P between the first flow path 30A and the first flow path 30A. Heat of the refrigerant flowing in the second flow path 30B is thus less likely to be transferred to the end surface 26*a* of the heat transfer tube 26 for further inhibition of frost. The distance (the thickness of the wall 26*b*) t1 between the first flow path 30A and the second flow path 30B is also equal to the distance t1 between the first flow paths 30A.

As depicted in FIG. 7, the groove 27*a* provided in the fin 27 has a first portion 27*a*1 having a vertical length L3 substantially equal to the vertical length of the heat transfer tube 26, and a second portion 27*a*2 disposed in an end part of the fin 27 in the first direction P and having a larger vertical length than the first portion 27*a*1. FIG. 7 includes L4 denoting a maximum vertical length in the second portion 27*a*2, and W denoting a range of the second portion 27*a*2 in the first direction P.

The end surface 26*a* of the heat transfer tube 26 has the semiarcuate section. The end surface 26*a* of the heat transfer tube 26 has a part disposed in the first portion 27*a*1 of the groove 27*a*, and a remaining part disposed in the range W in the first direction P of the second portion 27*a*2 of the groove 27*a*. The end surface 26*a* of the heat transfer tube 26 and the first portion 27*a*1 of the groove 27*a* are disposed close to each other with a space S provided therebetween.

The end surface 26*a* of the heat transfer tube 26 has a radius of about 1.0 mm, and the end surface 26*a* of the heat transfer tube 26 disposed in the second portion 27*a*2 has a length L5 in the first direction P, and the length L5 may be from 0.20 mm to 0.24 mm, and may, for example, be 0.22 mm.

Other Embodiments

The protrusions 31 provided at the first flow path 30A and the second flow path 30B may alternatively be provided on the inner surfaces located on the short sides in the sections of the first flow path 30A and the second flow path 30B, or may still alternatively be provided on both the inner surfaces located on the long sides and the inner surfaces located on the short sides.

The second flow path 30B according to the above embodiments has the rectangular section. The section may alternatively have a different shape such as a square shape or a circular shape.

The end surface 26*a* in the first direction P of the heat transfer tube 26 according to the above embodiments has the semiarcuate shape. The end surface 26*a* may alternatively have a flat surface extending in the vertical direction.

[Operation and Effects]

In the heat transfer tube according to PATENT LITERATURE 1, each of the flow paths has a rectangular section elongated in the alignment direction of the plurality of flow paths. The inner surface of each of the flow paths can thus have many protrusions for further increase in contact area with the refrigerant. Moreover, the heat transfer tube has a smaller number of internal flow paths to advantageously decrease a difference in heat exchange efficiency between an upstream side and a downstream side of an air flow in the alignment direction of the plurality of flow paths. However, increase in length of a long side of the rectangular section of the flow path leads to decrease in speed of the refrigerant flowing in each of the flow paths, which may deteriorate heat exchanging performance. Each of the flow paths thus needs to have a size set appropriately for improvement in heat exchanging performance. Therefore, one or more embodiments of the present disclosure provide a heat transfer tube and a heat exchanger that can improve heat exchanging performance.

(Operation and Effects)

(1) The heat transfer tube 26 according to the above embodiments includes the plurality of first flow paths 30A aligned in the heat transfer tube, in which the first flow paths 30A each have the section in the rectangular shape elongated in the first direction P in parallel with the alignment direction of the plurality of first flow paths 30A, the first flow paths 30A each have the inner surface provided with the plurality of protrusions 31, and the section of each of the first flow paths 30A has the long side having the length L1*a* and the short side having the length L1*b*, the lengths having the ratio from 1.1 to 1.5. This enables appropriate setting of the ratio in length between the long side and the short side in the section of the first flow paths 30A and improvement in heat exchanging performance.

(3) According to the above embodiments, the heat transfer tube 26 has the inner end part in the first direction P provided with the second flow path 30B, and the second flow path 30B has the sectional area smaller than the sectional area of the first flow paths 30A. The heat transfer tube 26 is likely to have frost at the end part in the first direction P. The sectional area of the second flow path 30B is thus made smaller than the sectional area of the first flow path 30A such that the second flow path 30B is made small in refrigerant flow rate for inhibition of frost.

(4) According to the above embodiments, the second flow path 30B is provided at each inner end part of the heat transfer tube 26 in the first direction P. This can thus achieve inhibition of frost at the respective end parts of the heat transfer tube 26 in the first direction P.

(5) According to the above embodiments, the maximum distance t2 in the first direction P between the second flow path 30B and the end surface 26*a* of the heat transfer tube 26 in the first direction P closest to the second flow path 30B is larger than the distance t1 in the first direction P between two of the first flow paths 30A adjacent to each other. The heat transfer tube 26 is likely to have frost on the end surface 26*a* in the first direction P. The maximum distance t2 between the second flow path 30B and the end surface 26*a* of the heat transfer tube 26 is thus made longer than the distance t1 between the adjacent first flow paths 30A such that heat of the refrigerant flowing in the second flow path 30B is less likely to be transferred to the end surface 26*a* of the heat transfer tube 26 for inhibition of frost.

(6) The outdoor heat exchanger 14 according to the above embodiments includes the headers 21 and 22, the plurality of heat transfer tubes 26 aligned in the longitudinal direction of the headers 21 and 22 and having the end parts connected to the headers 21 and 22, and the fin 27 in contact with the outer circumferential surface of each of the heat transfer tubes 26, in which the fin 27 is in contact with the outer circumferential surface of the heat transfer tube 26 except the end surface 26*a* on the side of the heat transfer tube 26 in the first direction P, and the second flow path 30B is provided on the side in the heat transfer tube 26. The end surface 26*a* on the side of the heat transfer tube 26 not in contact with the fin 27 is lower in temperature than the remaining portion in contact with the fin 27 and is thus likely to have frost. The second flow path 30B is provided at the end part on the side in the heat transfer tube 26 to reduce the refrigerant flow rate for inhibition of frost.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

21 liquid header
22 gas header
26 heat transfer tube
26*a* end surface
27 fin
30A first flow path
30B second flow path
31 protrusion

What is claimed is:

1. A heat transfer tube comprising:
first flow paths aligned in the heat transfer tube; and
a second flow path disposed in an inner end part of the heat transfer tube along a first direction parallel with an alignment direction of the first flow paths, wherein
each of the first flow paths includes:
a section with a rectangular shape that is elongated in the first direction; and
protrusions disposed on an inner surface,
the second flow path includes:
a section with a rectangular shape or a square shape; and
protrusions disposed on an inner surface,
an end surface in the first direction of the heat transfer tube has a semiarcuate section,
the section of each of the first flow paths has a long side having a first length and a short side having a second length, where a ratio of the first length to the second length is between 1.1 and 1.5,
the second flow path has a sectional area that is smaller than a sectional area of each of the first flow paths, where an aspect ratio of the second flow path is less than 1.1, and
each inner end part of the heat transfer tube along the first direction includes the second flow path.

2. The heat transfer tube according to claim 1, wherein
the first flow paths that are adjacent to each other are separated by a distance between 0.5 mm and 0.6 mm.

3. The heat transfer tube according to claim 1, wherein
a maximum distance in the first direction between the second flow path and an end surface of the heat transfer tube closest to the second flow path is larger than a distance in the first direction between two of the first flow paths that are adjacent to each other.

4. A heat exchanger comprising:

headers; and heat transfer tubes, according to claim 1, that are aligned in a longitudinal direction of the headers, wherein end parts of the heat transfer tubes are connected to the headers.

5. A heat exchanger comprising:

headers;

heat transfer tubes, according to claim 1, that are aligned in a longitudinal direction of the headers; and a fin disposed in contact with an outer circumferential surface of each of the heat transfer tubes except an end surface on a side of the heat transfer tube in the first direction, wherein end parts of the heat transfer tubes are connected to the headers.

6. The heat transfer tube according to claim 1, wherein the protrusions are disposed on portions of the inner surface that are parallel with the first direction.

* * * * *